United States Patent [19]

Bullock et al.

[11] 4,423,669

[45] Jan. 3, 1984

[54] AIR CURTAINING APPARATUS

[75] Inventors: Norman J. Bullock, Prospect; John W. Snyder, Louisville, both of Ky.

[73] Assignee: Cissell Manufacturing Company, Louisville, Ky.

[21] Appl. No.: 354,216

[22] Filed: Mar. 3, 1982

[51] Int. Cl.[3] ..... F24F 9/00

[52] U.S. Cl. ..... 98/36; 98/41 SV; 98/115 R

[58] Field of Search ..... 98/36, 41 SV, 115 R; 126/299 R, 299 D; 68/5 C, 20

[56] References Cited

U.S. PATENT DOCUMENTS

| | | | |
|---|---|---|---|
| 2,935,925 | 5/1960 | D'Ooge | 98/36 |
| 3,131,687 | 5/1964 | Kalla | 98/36 X |
| 3,303,839 | 2/1967 | Tavan | 126/299 D |
| 3,625,133 | 12/1971 | Hayashi | 98/36 |
| 3,834,293 | 9/1974 | Danieli | 98/36 |
| 4,127,106 | 11/1978 | Jensen | 126/299 D |

FOREIGN PATENT DOCUMENTS

| | | | |
|---|---|---|---|
| 813872 | 1/1938 | France | 98/36 |
| 212152 | 3/1924 | United Kingdom | 98/36 |

*Primary Examiner*—Albert J. Makay
*Assistant Examiner*—Harold Joyce
*Attorney, Agent, or Firm*—Wood, Herron & Evans

[57] ABSTRACT

An air curtaining apparatus is disclosed that forms a U-shaped air curtain around a steam and heat-emitting piece of machinery, such as a garment form finisher, to protect an operator from heat and moisture emitted during operation of the form finisher while permitting manipulation of a workpiece disposed thereon.

5 Claims, 2 Drawing Figures

AIR CURTAINING APPARATUS

BACKGROUND OF THE INVENTION

An "air curtain" is a directed high velocity sheet of air, typically planar in form, which functions as an environmental divider between two zones which it is desired to isolate on an environmental basis without impeding free passage of people or objects across the boundary. Air curtains have found numerous applications where it is desired to isolate a localized area from its surroundings, such as building entrances, hospital clean rooms, and the like.

In the garment finishing industry, many devices are employed which emit steam and heat in the course of fabric treatment. One such device is a form finishing machine, which sequentially steams and hot air dries a garment placed thereabout for the purpose of shaping it and removing wrinkles. In use, a garment is placed on the form finisher by an operator, and steam and air are then passed outwardly through it and into the garment being treated to relax the fibers in the garment and thereby remove wrinkles from it. Hot air, without steam, is thereafter applied in the same way to dry the garment.

Form finishers vent large quantities of steam and heat to the discomfort of the operator as well as others in the work place. Moreover, the operator cannot adjust or smooth a garment on the form finisher during the finishing operation without being directly subjected to steam and heat emitted by the finisher. Heretofore it has been proposed to enclose the form finisher in a cabinet as a means of containing the steam and heat. However, this inhibits ready access by the operator to the garment for readjusting it on the form, which often is necessary in use. It also inhibits manual application of specialized treatments to the garment, such as application of a concentrated steam/water spray from a hand-held nozzle, which serves to raise nap and break down hard-set wrinkles in localized areas of a garment which may have failed to respond to a previous generalized application of steam over the entire garment during the form finisher steaming cycle.

SUMMARY OF THE INVENTION

It is a primary object of this invention to provide a structurally simple air curtaining apparatus having simple and effective air flow controls which will effectively environmentally isolate a steam and heat-emitting piece of machinery, such as a garment form finisher, to thereby protect the operator as well as the general work environment from vapors and heat produced by the machine, and yet not inhibit easy and convenient manual access to a garment being finished.

It is yet another object of the invention to environmentally isolate the form finisher, while recirculating the major portion of the moisture and heat laden air contained by the air curtain, with venting only of excess moisture and heat, thereby preserving energy by not unnecessarily venting steam and heat useful in the fabric finishing operation.

The foregoing objectives of the invention are accomplished by providing a U-shaped horizontal air-emitting manifold having a central segment flanked on either side by side segments, an air-collecting hood aligned with the manifold which has a dual outlet blower for recirculating major portion of collected air and exhausting a minor portion, a pair of vertical ducts which extend between opposite inlet ends of the manifold side segments and the dual outlets of the blower for simultaneously conveying air between the blower and manifold and providing the sole support for the hood and blower, and an air deflector in each of the side segments of the manifold for diverting upwardly from each side manifold segment a portion of the air input thereto and passing the remaining input air portion to opposite ends of the central manifold segment for upward emission thereby. Preferably, each deflector is an upwardly inclined panel which spans only the upper portion of its associated side manifold segment to direct only a portion of the entering air in an upward direction for emission by the side manifold segments, while permitting the remaining portion of entering air to pass horizontally beneath and beyond the deflectors to the central manifold segment for upward emission therefrom.

In a preferred form of the invention a damper is provided in each air inlet of the manifold. The dampers each principally include a vertical panel having a vertical slot therein. The panel is vertically shiftable on a selective basis to alter the flow rate of air entering the inlet ends of the manifold from the vertical ducts. The vertical slots assure at least some horizontally directed air flow into the manifold side segments throughout substantially the entire height thereof regardless of the vertical position of the damper panels, in turn assuring some vertical air emission from the manifold side segments between the air inlet and the deflector and some inlet air flow beneath and beyond the inclined deflectors to the central manifold segment for vertical emission therefrom.

DETAILED DESCRIPTION OF THE DRAWINGS

DETAILED DESCRIPTION OF THE PREFERRED EMBODIMENT

Figures 1, 2:
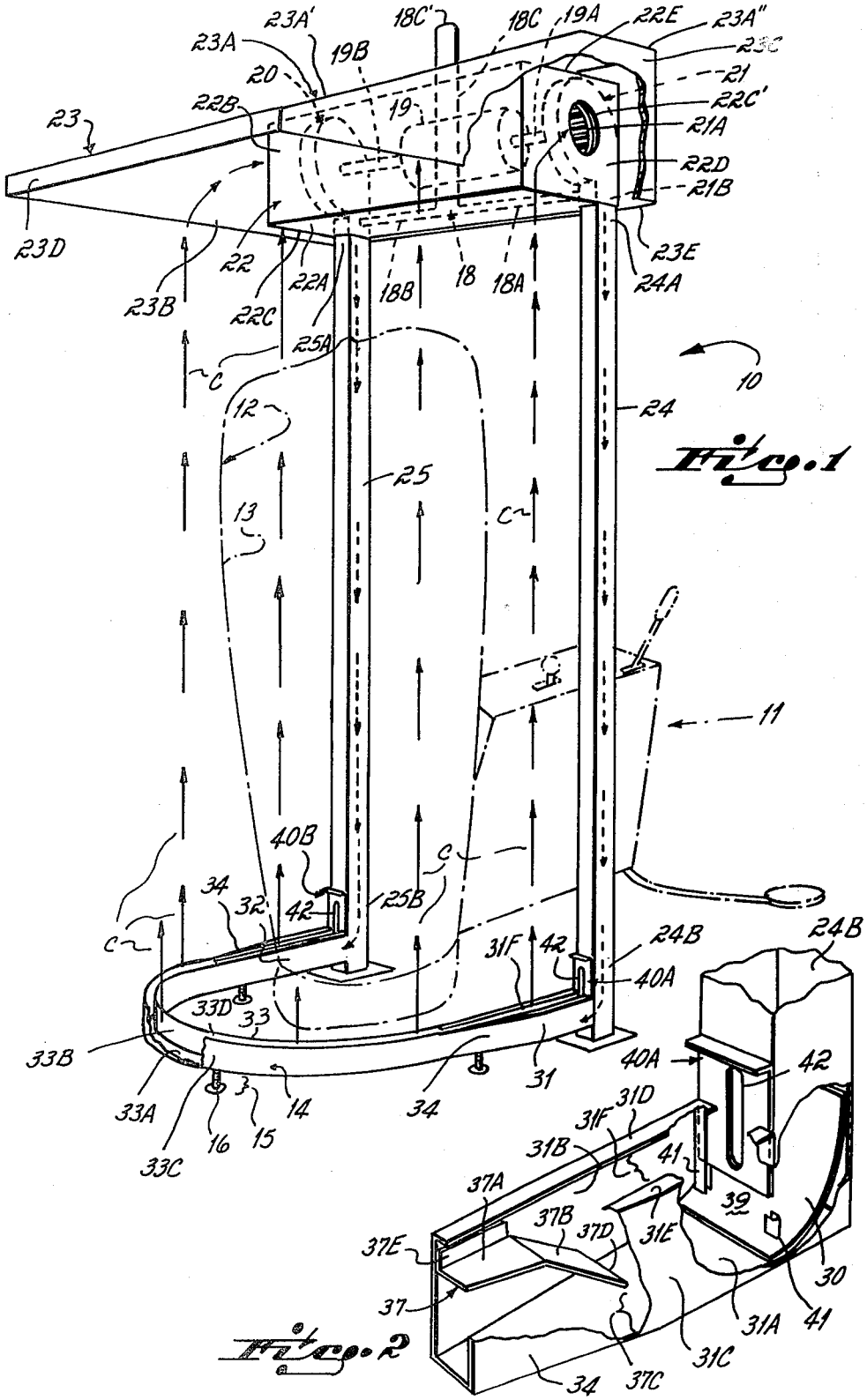
FIG. 1 is a perspective view of the air curtaining apparatus of this invention partially broken away for detail of the blower assembly; arrows indicate air flow direction.
FIG. 2 is an enlarged perspective view of the encircled portion of FIG. 1, partially broken away for detail.

FIG. 1 shows the air curtaining apparatus of this invention generally indicated at 10. The apparatus 10 is depicted as it would be used with a garment form finishing machine 11 (shown in phantom), which is its principle application. Such form finishers 11 have a revolving garment form 12 which is covered by a porous bag 13. Steam and heated air alternately vented into the form 11 are distributed through the bag 13, shaping a garment (not shown) on the form while removing wrinkles in the fabric. Easy and unhindered access to the form 12 is desirable to facilitate use of the form finisher in general, and in particular to enable an operator to smooth and adjust a garment in the course of treatment. Where a manual, or hand-held, steam/water gun is used (not shown) in the treatment process to raise nap and eliminate localized hard-set wrinkles in a garment, simple access to the form 12 without the hindrance of opening and closing access doors is also necessary for maximum efficiency in operation.

The air curtaining apparatus 10 is free standing and self supporting and is largely constructed of sheet metal. The air curtain produced, which is depicted with upwardly directed vertical arrows C, surrounds the form 12 on three sides and permits access by an operator to the form 12 at all times. A manifold 14, from which an upwardly directed vertical air curtain C issues, is U-shaped to match the front and opposite side portions of the form finisher 11, and is configured to provide an upwardly vertically extending air curtain in close proximity to the front and sides of the garment form 12. An operator can thus manipulate a garment on the form 12 without abnormal reaching or stretching over the manifold 14. A slight gap 15 is maintained below the manifold 14 through the use of adjustable screws 16 to provide toe room for the operator.

Although no air curtain encloses the rear of the form finisher 11, relatively little steam and heat escapes due to the extent of the opposite side or lateral portions of the air curtain. Effective containment of heat and steam produced in the form 12 and protection of the operator from the same is thus achieved by this U-shaped air curtain. The U-shape of the manifold 14, and open back to the apparatus 10, further permits simple installation in operative relationship to a form finisher 11.

The apparatus 10, in addition to the manifold 14, further includes a hood 23 for collecting return air. The hood 23 is dimensioned and configured to overlie and extend horizontally beyond the confines of the manifold 14 to facilitate efficient collection of air from curtain C at the upper extremity thereof. The hood 23 includes a roof 23A having a front section 23A' which slopes downwardly and a rear section 23A" which is horizontal, with the front and rear section being contiguous. Hood 23 further includes opposite left and right vertical sides 23B and 23C, a front panel 23D of limited vertical height, and a rear vertical panel 23E.

Located within hood 23, in the rear portion thereof, is an enclosure or housing 22 for a pair of blowers 20 and 21 and a stationarily mounted motor 19 which drives the blowers from opposite ends 19A and 19B of its two-ended output drive shaft. Housing 22 includes a horizontal bottom panel 22A, a vertical front panel 22B, vertical opposite side panels 22C and 22D, a horizontal top panel 22E and a rear panel 22F, which are all rectangular in shape. Rear housing panel 22F is disposed proximate rear hood panel, 23E, and housing top panel 22E is disposed proximate hood roof section 23A". For reasons to become apparent hereafter, side enclosure panels 22C and 22D are spaced inwardly from hood side walls 23B and 23C, respectively.

Blowers 20 and 21 are of the centrifugal type. Since each is identical, only blower 21 is described. Blower 21 includes a central circular air inlet 21A and a downwardly directed air outlet 21B. Blower inlet 21A communicates with a circular opening 22C' formed in housing side panel 22C, while blower outlet 21B communicates jointly with the right end 18A of a tee-shaped exhaust pipe 18 and the upper end 24A of a vertical duct 24 which at its lower end 24B connects to the right rear portion of manifold 14. Similarly, blower 20 and an air inlet and an air outlet which respectively connect with a circular opening in housing side panel 22D, and jointly with the left end 18B of the exhaust pipe 18 and the upper end 25A of a vertical duct 25 which at its lower end 25B connects to the left rear portion of manifold 14. Exhaust pipe 18 has a vertical section 18C which vents to the atmosphere via upper end 18C'. The lower end of vent pipe 18C connects to pipe sections 18A and 18B.

In operation, upwardly directed air from curtain C collected by hood 23 is drawn into the blower inlets of blowers 20 and 21, respectively, via the air passages defined by the space between confronting spaced apart portions of panels 23B and 22C and the space between confronting spaced apart portions of panels 23C and 22D, respectively. The air input to blowers 20 and 21 is then output in a downwardly direction to ducts 24 and 25 via blower outlets for input to opposite rear portions of the manifold 14. A small portion of the air ouput from blowers 20 and 21, for example, 10%, is exhausted to the atmosphere via vent pipe 18, for reasons to be described in detail hereafter.

Air forced down the ducts 24 and 25 by blowers 21 and 20 is deflected at the lower ends 24B and 25B thereof and thereby introduced into manifold 14 by a curved deflector plate 30, only one of which is shown in FIG. 2. A similar deflector plate (not shown) is provided in the lower end 25B of duct 25. The deflector 30 changes the downwardly directed air flow in duct 24 by 90° in a smooth curve, reducing air turbulance at this jointure, for introduction into the right rear end of the manifold 14. The similarly located deflector plate (not shown) in the lower section 25B of duct 25 facilitates turbulent-free air flow from duct 25 into the left rear end of manifold 14.

The manifold 14 is composed of two elongate right and left rear segments 31 and 32 which interconnect with an arcuate front segment 33. The rear base segments 31 and 32 are wider at their respective rearward ends where they connect to lower duct ends 24B and 25B than they are at their respective forward ends where they join the opposite ends of the arcuate portion 33. Base segments 31 and 32 have a tapered portion 34 that reduces the lateral width of the segment to that of the arcuate segment 33.

Base segments 31 and 32 of manifold 14 are similarly constructed; therefore, only segment 31 is described. Segment 31 includes a horizontal bottom panel 31A, and opposite vertical inner and outer side panels 31B and 31C. Horizontal lips 31D and 31E extend toward each other from the upper edges of side panels 31B and 31C to define an air curtain outlet slot 31F.

Arcuate manifold section 33 includes a bottom panel 33A from the opposite sides of which extend upwardly inner and outer vertical sections 33B and 33C. Manifold sections 33A, 33B and 33C collectively form an open-top arcuate manifold segment, with the opening 33D therein defined by the upper edges of inner and outer vertical wall sections 33B and 33C.

The entire manifold consisting of arcuate section 33 located between opposite rear side sections 31 and 32, forms a horizontal conduit of generally U-shape, through the upper openings thereof, pressurized air travels to establish air curtain C. In practice, it has been found that a relatively constant one inch wide air exit opening in the manifold 14 is desired; thus, the upper slots in segments 33, 31 and 32 are one inch wide. Also, it has been found that a vertical depth of approximately six inches is useful for the segments 33, 31, and 32 of the manifold 14.

A relatively evenly distributed air curtain is formed by manifold 14 through the use of air guides 37 (only one of which is shown) which are positioned adjacent the intersection points between the opposite ends of arcuate portion 33 and rear base segments 31 and 32. As shown in FIG. 2, the air guide 37 of segment 31 is fixed in the forward portion thereof by a tab 37E spot welded to side wall 31B. The air guide 37, which spans walls 31B and 31C, has a forward horizontal section 37A, and a downwardly and rearwardly inclined vane 37B. The vane 37B redirects a portion of the horizontal air flow in segment 31 upwardly to exit segment 31 through slot 31F in a vertical direction. The inclined portion 37B extends downwardly to a point approximately equidistant between the upper and lower edges of the side walls 31B and 31C, leaving a space 37C between the lower edge 37D thereof and the bottom 31A. The air flowing in segment 31 below the lower edge 37D of deflector 37 enters the segment 33 where it exits vertically upwardly from slot 33D.

Adjustment of the air flow through the manifold 14 is obtained by air dampers 40A and 40B located at the junctions of the vertical ducts 24 and 25 and the rear ends of left and right segments 31 and 32. The dampers 40A and 40B are identical, therefore only damper 40A is described.

Damper 40A is vertically disposed transverse to the horizontal air flow entering the manifold 14 adjacent the intersection of the manifold rear base segment 31 and the duct 24 which communicate via opening 39. The damper 40A is made of sheet metal and is selectively positionable in vertical guides 41 secured to walls 31B and 31C of segment 31 to cover opening 39 to selectively variable degrees. A vertical slot 42 formed centrally in the damper 40A permits the passage of air through the damper even when in its lowermost, fully closed position, and controls the volume of the air flowing into the segment 31 from duct 24. Slots 42 assure at least some horizontally directed air flow throughout substantially the entire height of the side segments 31 and 32 regardless of damper position, in turn assuring, independent of damper position, some vertical emission of inlet air from the side manifold segments 31 and 32 and some flow of inlet air beyond the deflector panels 37 to the central manifold segment 33 for vertical emission therefrom.

As FIG. 1 illustrates, the air curtain formed by the manifold 14 is upwardly directed and in close proximity to the form 12. The hood 23 forms the upper limit of the air curtain, and is consequently of sufficient area to contain the air curtain produced. A slight negative pressure is maintained within the hood 23 by the action of blowers 20, 21 which serves to collect the air curtain for recirculation via manifold 14 as well as vent some of the steam and heat emitted by the form finisher 11.

Air drawn in from the hood 23 during operation of the form finisher is laden with heat and moisture. A substantial amount of this moisture and heat-laden air is recirculated through the system to enhance the garment finishing process. However, an excess of steam and heat is generally produced by the form finisher which advantageously is vented externally. Exhaust outlets 18A and 18B connect to the outlet side of the blowers 20 and 21 and communicate with the atmosphere via a mutual vertical exhaust pipe 18C. In general, about 10% of the total air being circulated is exhaused. This conserves energy by not unnecessarily exhausting heated, moisture laden air useful in the garment finishing operation, yet rids excess moisture and heat. Exhaust pipes 18A and 18B having a diameter of three inches and a vent pipe 18C of four inches diameter has proven satisfactory with blowers 20 and 21, each rated at ½ horsepower, which collectively circulate air at a rate of 400 cubic feet per minute.

The ducts 24 and 25, in addition to conveying pressurized air from the blower outlets, also constitute the structural support for the hood 23, housing 22, blowers 20 and 21, and motor 19. Thus, an economical and simplified structure is provided.

The foregoing is considered as illustrative of the principles of this invention. Since numerous modifications and changes will be apparent to those skilled in the art, modifications and equivalents of the invention which fall within the scope of the following claims are deemed to be encompassed by this invention.

What is claimed is:

1. An air curtaining apparatus comprising:

an elongated horizontally disposed generally U-shaped air manifold having an upwardly directed air outlet along substantially the entire length thereof to establish a U-shaped vertical air curtain and having first and second air inlets at opposite ends, thereof through which air is supplied to said manifold, said manifold including a central front segment and right and left side segments disposed on either side of said central segment between opposite ends of said central segment and said first and second manifold air inlets;

an air-collecting hood having an interior disposed above and in general vertical alignment with said manifold to collect air from said air curtain;

blower means structurally connected to said hood and having an air inlet communicating with said hood interior for removing collected air therefrom, and first and second air outlets at which pressurized air is provided, said first and second outlets disposed in vertical alignment with and above said first and second air inlets of said manifold;

first and second vertically disposed ducts interconnecting said first and second air outlets of said blower means and said first and second air inlets of said manifold for conveying pressurized air from said blower means to said manifold in a vertically downwardly direction, said first and second ducts structurally interconnecting said manifold with said hood and blower means to provide the sole support for said hood and blower means;

an air deflector in each of said right and left side segments of said manifold proximate their respective junctions with said central manifold segment, each said air deflector including an inclined panel spanning only the upper portion of its respectively associated side manifold segment, each said panel being inclined upwardly toward said central manifold segment to direct only a portion of the pressurized air entering said manifold inlets from said vertical ducts in an upwardly direction for emission from said side manifold segments while permitting the remaining portion of said entering air to pass in a horizontal direction beneath and beyond said deflectors to said central segment of said manifold located beneath said deflectors for upward emission therefrom; and a damper in each of said air inlets of said manifold, each said damper including a vertically disposed panel which defines a vertically extending slot within a respective side segment, each said panel being selectively vertically shiftable to facilitate altering the flow rate of air from said vertical ducts into said horizontal side manifold segments, said vertical slot so defined assuring at least some horizontally directed air flow into said side segments from said vertical ducts throughout substantially the entire height of said side manifold segments regardless of the vertical positions of said damper panels, in turn ensuring vertical emission of inlet air from said side manifold segments and some flow of inlet air beneath the deflector panels to the central manifold segment for vertical emission therefrom.

2. The apparatus of claim 1 further comprising:

a smoothly curved plate located at the junction of the lower end of each said vertical duct and its associated manifold air inlet to change the direction of air flow from vertically downwardly to horizontal with minimum turbulence at said manifold inlets.

3. The apparatus of claim 1 further comprising:

air exhaust means connected between the environment and at least one of said blower air outlets for exhausting a portion of said air collected by said hood which has been heated and/or moistened by a garment treating device which emits heat and/or moisture during use located between said manifold and hood which is being curtained by air flowing upwardly therebetween defining said U-shaped air curtain, exhausting a portion of said air collected thereby preventing an excessive accumulation of heat and/or moisture in said air curtain.

4. An air curtaining apparatus comprising:

an elongate horizontally disposed air manifold having a vertically directed air outlet along substantially the entire length thereof to establish an air curtain and having an air inlet at an end thereof through which air is supplied to said manifold;

an air-collecting hood having an interior disposed in general vertical alignment with said manifold to collect air from said air curtain;

blower means having an air inlet communicating with said hood interior for removing collected air therefrom, and an air outlet at which pressurized air is provided;

a duct interconnecting said air outlet of said blower means and said air inlet of said manifold for conveying pressurized air from said blower means to said manifold;

an air deflector in said manifold spaced from the air inlet end thereof, said air deflector including an inclined panel spanning only the upper portion of said manifold and being inclined toward said hood upwardly away from said air inlet end thereof to direct only a portion of the pressurized air entering said manifold inlet from said duct in a vertical direction toward said hood for emission from the initial segment of the manifold located between said deflector and said manifold inlet end, while permitting the remaining portion of said entering air to pass in a horizontal direction beyond said deflector to the remaining segment of said manifold located between said deflector to the other end of said manifold for vertical emission therefrom; and a damper in said air inlet of said manifold, said damper including a vertically disposed panel which defines a vertically extending slot within said manifold, said panel being selectively vertically shiftable to facilitate altering the flow rate of air from said duct into said manifold, said vertical slots so defined assuring at least some horizontally directed air flow into said initial manifold segment from said duct throughout substantially the entire height of said side initial manifold segment regardless of the vertical position of said damper panel, in turn ensuring vertical emission of inlet air from said manifold segment and some flow of inlet air beyond the deflector panel to the remaining manifold segment for vertical emission therefrom.

5. The air curtaining apparatus of claim 1, wherein said panel has a vertically extending slot therein.

* * * * *